US007249972B2

(12) United States Patent
Ohki et al.

(10) Patent No.: US 7,249,972 B2
(45) Date of Patent: Jul. 31, 2007

(54) ELECTRICAL CONNECTOR RECEPTACLE WITH LOCK NUT

(75) Inventors: Yasuo Ohki, Tokyo (JP); Yasuo Omori, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/378,301

(22) Filed: Mar. 20, 2006

(65) Prior Publication Data

US 2006/0216995 A1 Sep. 28, 2006

(30) Foreign Application Priority Data

Mar. 23, 2005 (JP) ..... 2005-083596

(51) Int. Cl.
*H01R 13/648* (2006.01)

(52) U.S. Cl. ..... 439/607

(58) Field of Classification Search ..... 439/607, 439/570, 571, 573, 676
See application file for complete search history.

(56) References Cited

U.S. PATENT DOCUMENTS 5,125,853 A * 6/1992 Hashiguchi ..... 439/607
5,249,983 A * 10/1993 Hirai ..... 439/573

FOREIGN PATENT DOCUMENTS

JP 5-72069 9/1993

* cited by examiner

*Primary Examiner*—Alexander Gilman
(74) *Attorney, Agent, or Firm*—Wenderoth, Lind & Ponack, L.L.P.

(57) ABSTRACT

An electrical connector receptacle having a simple connector housing structure, a secure grounding connection of a metal shell to ground, and excellent durability, includes a connector housing having a pair of locking sections with nut-storing-sections formed therein, nuts stored in the nut-storing-sections, and a metal shell covering the connector housing. The nut-storing-section is open at an upper side, and formed in a vertically elongated, concave shape with a depth to receive the nut fully, and has a screw-insertion-hole running through the locking section across the nut-storing-section, and a shell-strip through-hole running through the locking section above the screw-insertion-hole. A retaining through-strip is formed in the shell and is inserted into the shell-strip through-hole and contacted to an upper part of the nut stored in the nut-storing-section, thereby preventing falling-off of the nut, and providing electrically conduction to the nut.

3 Claims, 6 Drawing Sheets

ELECTRICAL CONNECTOR RECEPTACLE WITH LOCK NUT

BACKGROUND OF THE INVENTION

1. Field of the Invention

The present invention relates to an electrical connector receptacle with a lock nut in which a connection condition is firmly kept by screw fastening.

2. Related Art

As an electrical connecter receptacle having a metal shell for a measure against EMI used for connection of a personal computer, LAN device, measuring instrument or the like, for example, an electrical connecter receptacle has been known, wherein the metal shell is electrically connected to a conductive nut fitted in a through-hole of a connector body and a metal sheet member by using screws, and when the receptacle is mounted on a printed circuit board, the shell is grounded to a conductive portion of the relevant printed circuit board (refer to JP-U-5-72069).

However, in such a conventional electrical connector receptacle, the conductive nut is fitted in the through-hole of the connector receptacle body, and the metal shell is fixed by the screws and thus electrically conducted to the nut. That is, since screws and nuts are used for structures for fixing the metal shell and fixing the connector to the printed circuit board, a nut-storing-structure of the connector body becomes complicated, and the number of components is increased. In addition, the number of fixation operations is increased, and consequently much time is required. Moreover, since a condition of connection to an electrical connector plug as the other connector is made only by fitting-in of a connection port, and the screw and the nut for securely and firmly holding the connection condition are not used for locking, connection performance is inferior in reliability.

SUMMARY OF THE INVENTION

It is an object of the present invention to solve such problems in the conventional art and provide an electrical connector receptacle with a lock nut that is simple in structure and securely grounded.

Thus, an electrical connector receptacle according to the invention is configured to include a connector housing having a pair of locking sections in which nut-storing-sections are formed, nuts stored in the nut-storing-sections, and a metal shell that covers part of an outer surface of the connector housing. The nut-storing-section is open at an upper side, and formed in a vertically elongated, concave shape with a depth at which the nut is fully received, and has a screw-insertion-hole running through the locking section in a back and forth direction across the nut-storing-section, and a shell-strip through-hole running through the locking section above the screw-insertion-hole and in the back-and-forth direction across the nut-storing-section. A retaining through-strip is formed in the shell, which is inserted into the shell-strip through-hole and contacted to an upper part of the nut stored in the nut-storing-section, thereby preventing falling-off of the nut and providing electrical conduction to the nut.

Preferably, a latching strip is extendedly provided at a front end of the retaining through-strip, which runs through the shell-strip through-hole and is bent in a vertical direction to fix the shell to the connector housing. Moreover, a projection for pressing the nut is preferably formed on a bottom side of the retaining through-strip.

According to the electrical connector receptacle of the invention, the nut stored in the nut-storing-portion of the connector housing is contacted to the retaining through-strip as a part of the metal shell, such that the nut is electrically conducted to the shell and retained, in addition, when the nut is screw-clamped by a screw of a connector plug as the other connector, a metal shell of the connector plug as the other connector is also electrically conducted via the screw and thus connected to ground (conductive portion) of a printed circuit board. Thus, the nut is retained by attaching the metal shell to the connector housing. In addition, since only this kind of nut for retaining the screw is used, a housing configuration of the nut-storing-section can be made in a simple structure. Moreover, since connection to the ground is made using the screw and the nut, the ground connection is securely made, and a condition of the grounding is excellent in durability.

Moreover, since the latching strip for fixing the shell, which runs through the shell-strip through-hole and is bent in the vertical direction, is formed at the front end of the retaining through-strip, when the metal shell is attached to the connector housing, the latching strip is inserted into the shell-strip through-hole, and the strip which is protruded from the hole is bent upward or downward. In this manner, operation of fixing the shell to the relevant connector housing is easily carried out, and an electrical conducting structure is simplified.

Furthermore, the projection for pressing the nut is formed on the bottom side of the retaining through-strip, and thereby the nut stored in the nut-storing-section is fixed in a stable condition without rattling, and an electrical conducting condition between the metal shell and the nut becomes stable.

DETAILED DESCRIPTION OF THE PREFERRED EMBODIMENTS

Figure 1A:
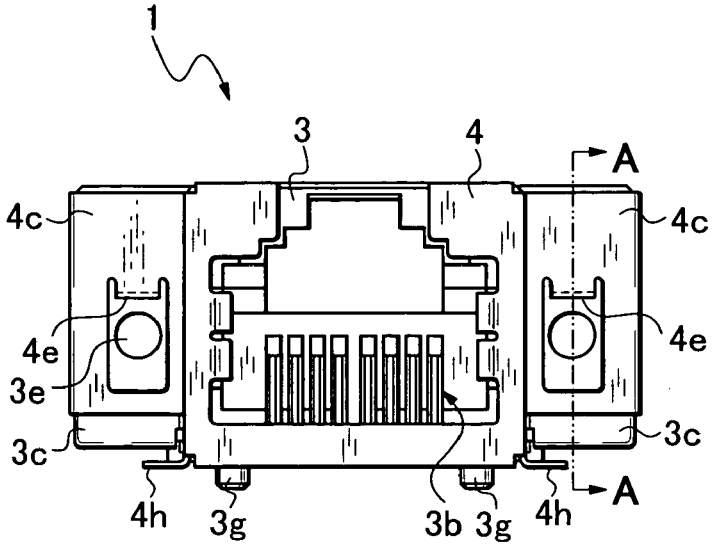
FIGS. 1A, 1B and 1C are front, right side and back views respectively showing an electrical connector receptacle with a lock nut, according to an embodiment of the invention.
Figure 1B:
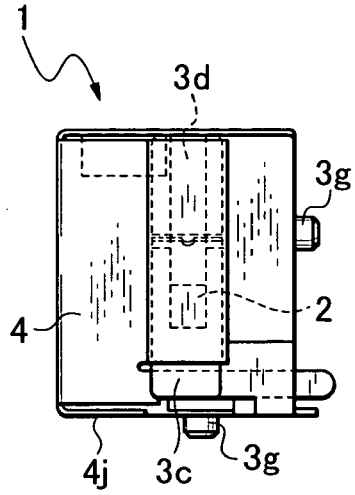
Figure 1C:
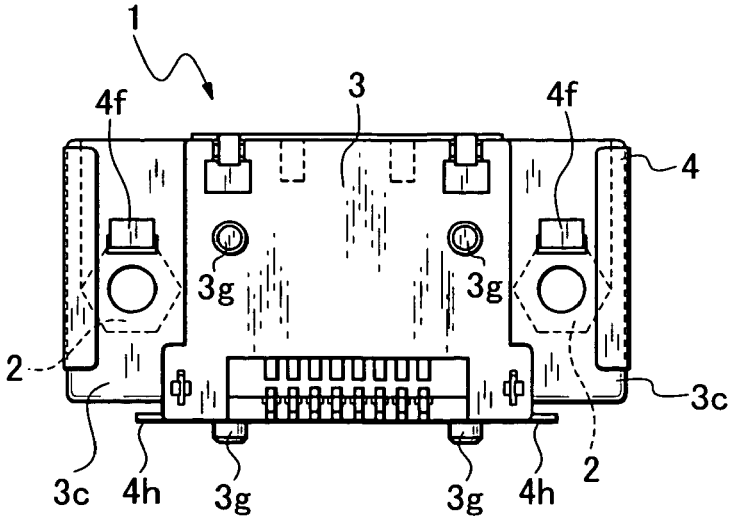

An electrical connector receptacle 1 according to an embodiment of the invention is applied, for example, to a plug-in phone connector for a network used for internet connection in the personal computer, LAN device or the like, and as shown in FIG. 1A to FIG. 1C, it has a synthetic-resin connector housing 3 integrally having a pair of locking sections 3*c*, 3*c* on either side, and a metal shell 4 that covers part of an outer surface of the connector housing 3 as a measure against EMI. A nut-storing-section 3*d* is formed in the locking section 3*c*, and a nut 2 for fixation by fitting-in is stored in the nut-storing-section 3*d*.

Figure 2A:
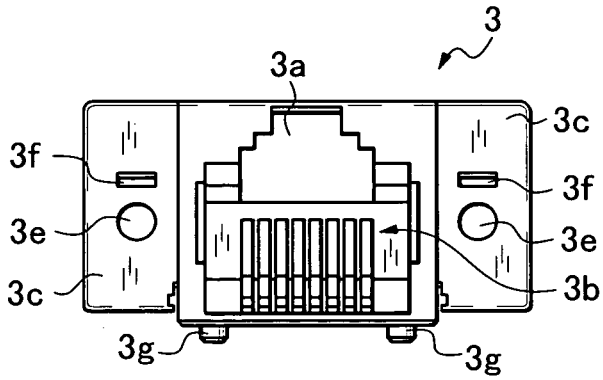
FIGS. 2A, 2B, 2C, 2D and 2E are front, plan, bottom, right side and back views respectively showing a connector housing of the electrical connector receptacle with the lock nut.

In the connector housing 3, as shown in FIG. 2A, a fitting-in space 3*a* in which a modular jack is inserted and fitted is formed largely in a front and central portion, and a plurality of contacts 3*b* extending upward from the lower side of the housing are provided. On either lateral side of the connector housing 3, the locking section 3*c* is integrally provided in a protrusive manner. The locking section 3*c* is protruded with a certain width from a slightly rearward position with respect to the center of a sidewall of the connector housing 3.

Figure 2B:
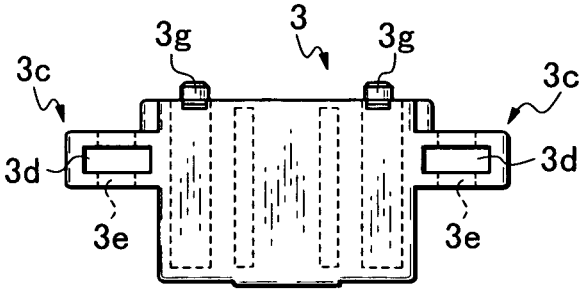
Figure 2C:
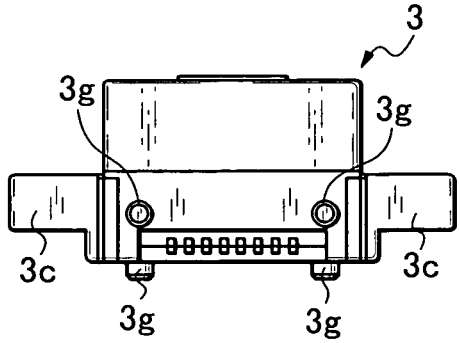
Figure 2D:
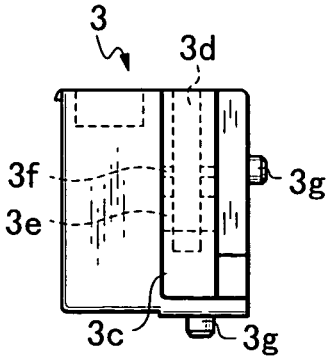
Figure 2E:
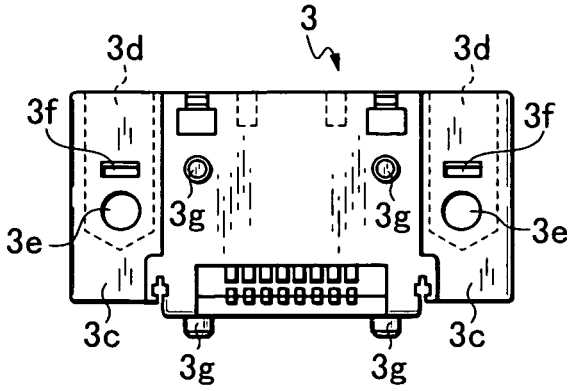
Figure 3A:
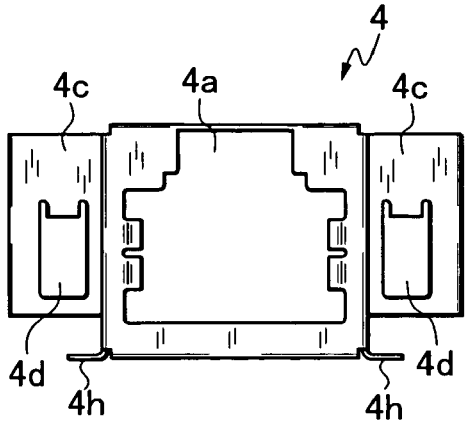
FIGS. 3A, 3B, 3C, 3D and 3E are front, plan, bottom, right side and back views respectively showing a metal shell of the electrical connector receptacle with the lock nut.
Figure 3B:
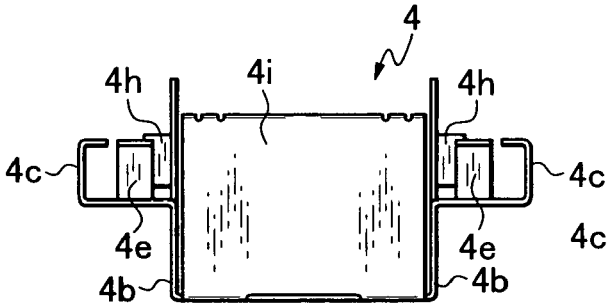
Figure 3C:
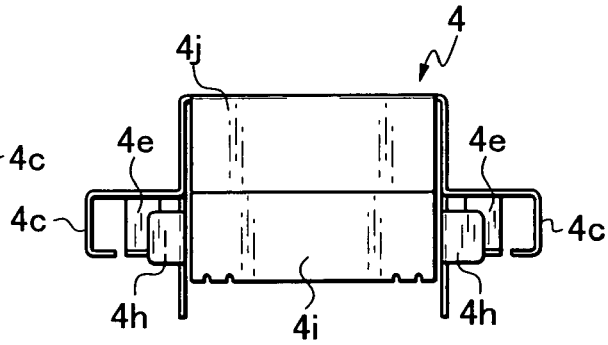
Figure 3D:
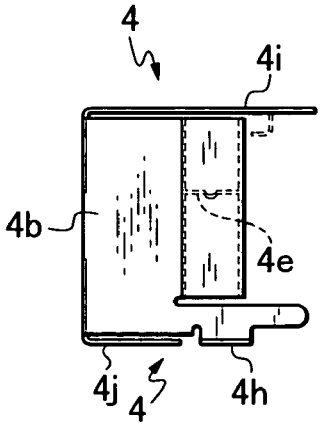
Figure 3E:
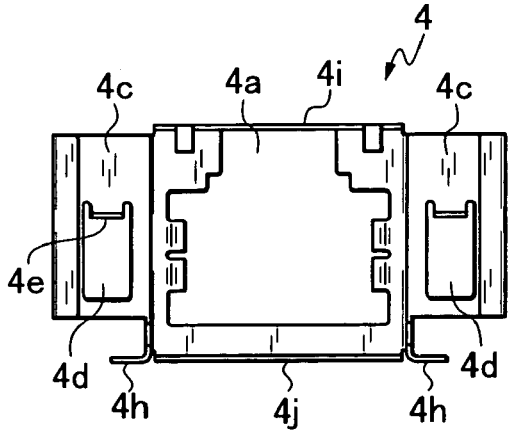

As shown in FIGS. 2B, 2D and 2E, the nut-storing-section 3*d* formed in the locking section 3*c* is a cylindrical recess having a rectangular section, which is opened at an upper side and elongated vertically, and formed in a depth at which a sideways hexagon-nut is fully received. The nut-storing-section 3*d* has a width in a back and forth direction, which corresponds to a thickness of the nut to be stored but is slightly larger than the thickness of the nut.

In the locking section 3*c*, a screw-insertion-hole 3*e* is formed through the locking section 3*c* in a back and forth direction across the nut-storing-section 3*d*. Moreover, a shell-strip through-hole 3*f* is formed above the screw insertion hole 3*e* and runs through the locking section 3*c* in the back and forth direction. Furthermore, a pair of bosses 3*g* is projected from each of back and bottom sides of the connector housing 3, the bosses being for positioning when the electrical connector receptacle 1 is mounted on the printed circuit board.

On the other hand, the metal shell 4 shown in FIGS. 3A to 3E almost completely covers the connector housing 3 as a measure against EMI, as shown in FIG. 1, and for example, is made of stainless steel. A punch-out hole 4*a* corresponding to a fitting-in shape of the fitting-in space 3*a* is formed in a central portion of the connector housing 3, and a locking-section-cover 4*c* for covering the locking section 3*c* having the nut-storing-section 3*d* is formed on each lateral portion. The locking section cover 4*c* is folded along the locking section 3*c* from a sidewall portion 4*b* covering the sidewall of the connector housing 3 leaving a lower end portion (refer to FIGS. 3B and 3C).

A hole 4*d* for screw insertion is formed in a front side of the locking section cover 4*c* in a position corresponding to the screw-insertion-hole 3*e*. The hole 4*d* is formed in a vertically long, rectangular shape in such a cut-and-raise form that a strip of the shell is folded rearward with an upper edge as an axis, and the cut-and-raised shell strip is formed as a retaining through-strip 4*e* to be inserted into the shell-strip through-hole 3*f*. The retaining through-strip 4*e* is inserted into the shell-strip through-hole 3*f* and contacted to an upper part of the nut 2 stored in the nut-storing-section 3*d*, thereby preventing falling-off of the nut and providing electrical conduction to the nut.

Figure 4A:
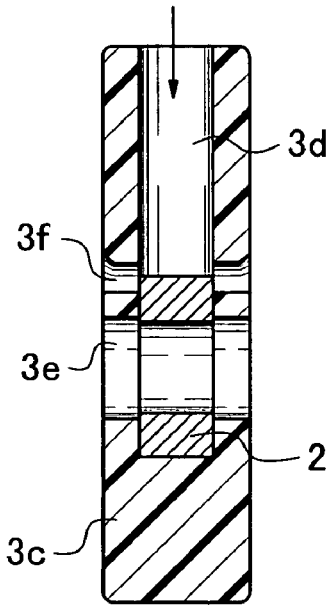
FIGS. 4A, 4B and 4C are vertical section views seen from a lateral side, respectively showing use situations of a nut and a retaining through-strip in a locking section of the connector housing.
Figure 4B:
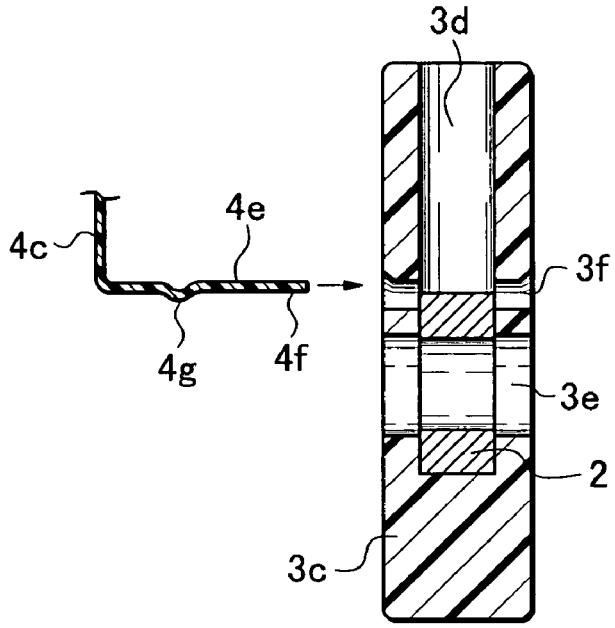
Figure 4C:
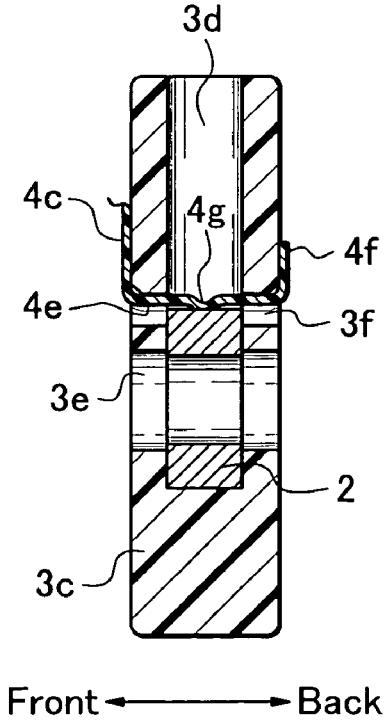

As shown in FIGS. 4B and 4C, a latching strip 4*f* is formed at a front end portion of the retaining through strip 4*e*, which runs through the shell-strip through-hole 3*f*, and is bent in an upward or a downward, vertical direction to fix the shell 4 to the connector housing 3. Furthermore, a projection 4*g* for pressing the nut 2 downward is formed in approximately the center of the retaining through-strip 4*e*.

An attachment strip 4*h* for fixing the shell to the printed circuit board and grounding the shell is provided in the rear of a lower end of the sidewall portion 4*b* of the shell 4 in a manner of being bent sideward. A top board 4*i* and a bottom board 4*j* are provided on a top and a bottom of the metal shell 4 respectively. In the metal shell 4 formed in this way, after the connector housing 3 is inserted into the shell from the front, a part of the shell including the latching strip 4*f* is vertically bent for retaining at the back side.

In the locking section 3*c*, as shown in FIG. 4A, before the metal shell 4 is attached to the connector housing 3, the nut 2 is dropped into the nut-storing-section 3*d* from an opening at an upper side of the section. Then, as shown in FIG. 4B, the retaining through-strip 4*e* of the metal shell 4 is inserted into the shell-strip through-hole 3*f* from a front side to a back side, and then the latching strip 4*f* as a protruded portion of the strip 4*e* is bent upward (refer to FIG. 4C). In this way, the retaining through-strip 4*e* of the metal shell 4 is fixed to the locking section 3*c* and thus falling-out of the nut 2 is prevented, and since the projection 4*g* of the retaining strip 4*e* presses the nut 2 downward, the nut 2 is fixed in the nut-storing-section 3*d* without rattling, in addition, stable electric conduction is achieved between the relevant nut 2 and the shell 4.

Figure 5A:
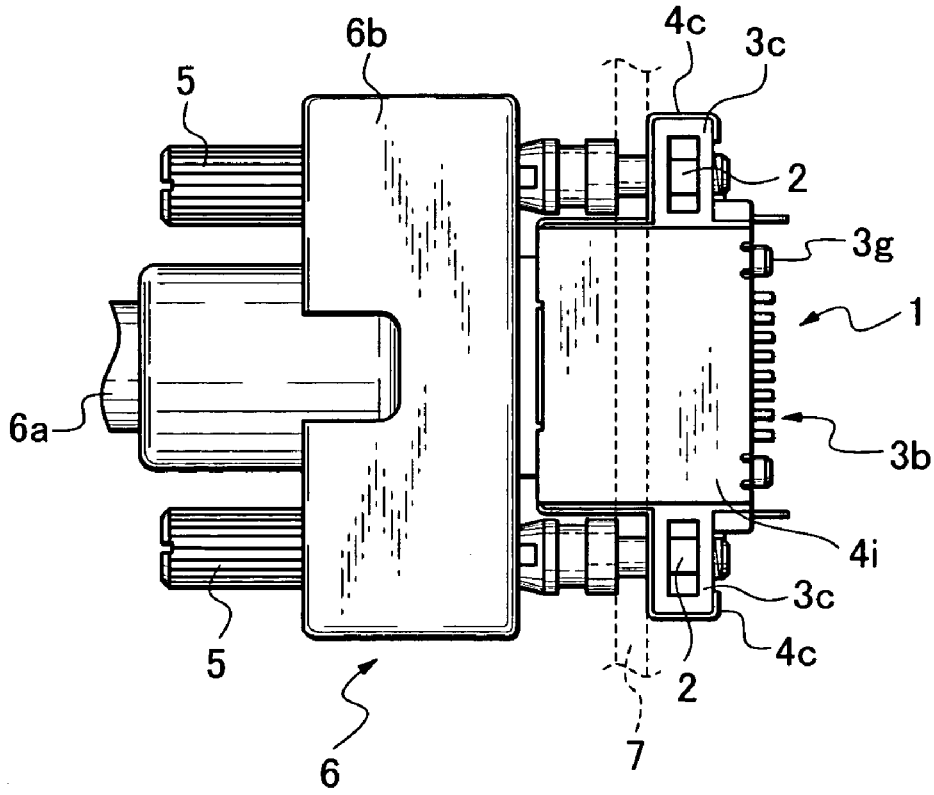
FIGS. 5A and 5B are plan and right side views respectively showing a use situation of the electrical connector receptacle with the lock nut.
Figure 5B:
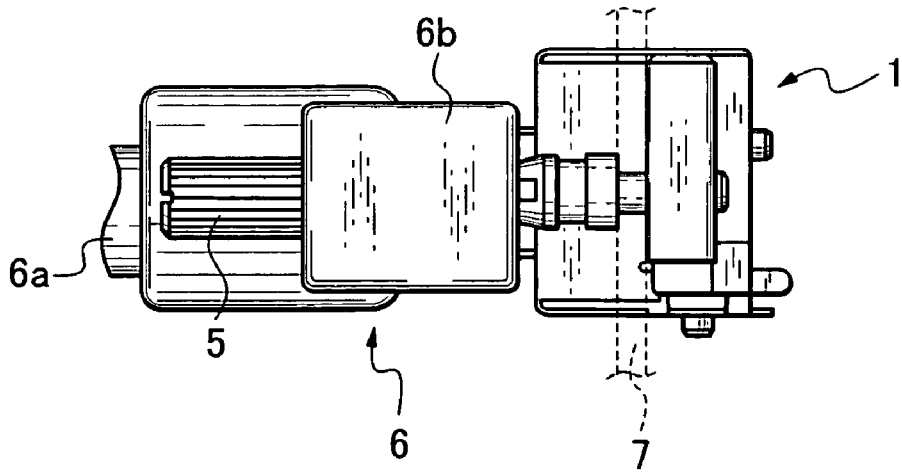

As shown in FIGS. 5A and 5B, the electrical connector receptacle 1 configured in this way is fixed to a panel 7 of an electronic device or the like, and connected with a connector plug 6 having a screw 5 on either side. Ground for an electrical shield of a cable 6*a* of the connector plug 6 is conducted to a metal shell 6*b* for the plug 6, and when the electrical connector receptacle 1 is connected to the connector plug 6, the metal shell 4 and the metal shell 6*b* are conducted and thus connected to the ground of the printed circuit board at a side of the electrical connector receptacle 1.

Figure 6:
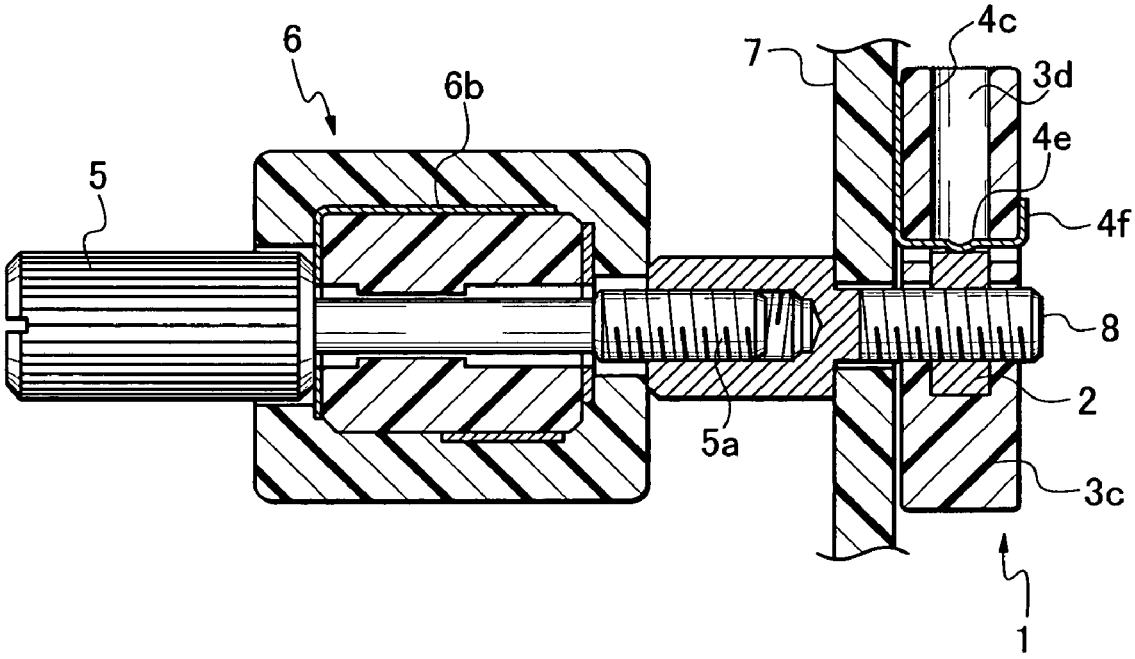
FIG. 6 is a vertical section view showing a use situation of the electrical connector receptacle with the lock nut in a partially enlarged manner.

In addition to such a grounding connection between the metal shells 4 and 6*b*, as shown in FIG. 6, the metal shell 6*b* for the connector plug 6 and the locked screw 5 are contacted and thus conducted. Then, a male screw portion 5*a* of the screw is conducted to an offset screw 8 for the panel 7 and to the nut 2 at the side of the electrical connector receptacle 1 in turn via the screw 5. Furthermore, a grounding connection is formed, along which the nut 2 is conducted to the retaining through-strip 4*e*, and then the metal shell 4 is connected to the ground of the printed circuit board on which the relevant electrical connector receptacle 1 is mounted. In this grounding connection, the screw 5 and the nut 2 are fastened, such that an electrical conduction channel is firmly secured, leading to excellent durability.

What is claimed is:

1. An electrical connector receptacle comprising:

a connector housing having at least one locking section in which a nut-storing-section is formed;

a nut stored in the nut-storing-section; and a metal shell that covers part of an outer surface of the connector housing;

wherein the nut-storing-section is open at an upper side, and formed in a vertically elongated, concave shape with a depth at which the nut is fully received, and has a screw-insertion-hole running through the locking section in a back and forth direction across the nut-storing-section, and a shell-strip through-hole running through the locking section above the screw-insertion-hole and in the back-and-forth direction across the nut-storing-section;

wherein a retaining through-strip is formed in the shell and is inserted into the shell-strip through-hole and contacted to an upper part of the nut stored in the nut-storing-section, thereby preventing falling-off of the nut and providing electrical conduction to the nut; and wherein a latching strip is extendedly provided at a front end of the retaining through-strip, which runs through the shell-strip through-hole and is bent in a vertical direction to fix the shell to the connector housing.

2. An electrical connector receptacle with lock nut according to claim 1, wherein a projection for pressing the nut is formed on a bottom side of the retaining through-strip.

3. An electrical connector receptacle with lock nut according to claim 1, wherein said at least one locking section comprises a pair of locking sections.

* * * * *